US005912553A

United States Patent [19]

Mengelkoch

[11] Patent Number: 5,912,553

[45] Date of Patent: Jun. 15, 1999

[54] ALTERNATING CURRENT FERRORESONANT TRANSFORMER WITH LOW HARMONIC DISTORTION

[75] Inventor: James F. Mengelkoch, Minnetonka, Minn.

[73] Assignee: Schott Corporation, Wayzata, Minn.

[21] Appl. No.: 08/786,684

[22] Filed: Jan. 17, 1997

[51] Int. Cl.[6] ..... G05F 3/06

[52] U.S. Cl. ..... 323/309; 336/165; 336/170; 336/178; 336/215

[58] Field of Search ..... 323/248, 306, 323/308, 309; 336/155, 165, 170, 178, 214, 215; 363/75

[56] References Cited

U.S. PATENT DOCUMENTS

| | | | |
|---|---|---|---|
| 2,212,198 | 8/1940 | Sola | 171/119 |
| 2,326,465 | 8/1943 | Keeler | 171/119 |
| 2,512,976 | 6/1950 | Smeltzly | 323/44 |
| 2,694,177 | 11/1954 | Sola | 323/60 |
| 2,996,656 | 8/1961 | Sola | 323/45 |
| 3,061,769 | 10/1962 | Smyth | 321/16 |
| 3,112,439 | 11/1963 | Rosin | 323/56 |
| 3,398,292 | 8/1968 | Kuba | 307/51 |
| 3,521,147 | 7/1970 | Ostreicher | 321/16 |
| 3,521,152 | 7/1970 | Emerson | 323/60 |
| 3,546,565 | 12/1970 | Downing, Jr. et al. | 323/6 |
| 3,546,571 | 12/1970 | Fletcher et al. | 323/60 |
| 3,584,290 | 6/1971 | Spreadbury | 323/6 |
| 3,681,679 | 8/1972 | Chung | 323/6 |
| 3,686,561 | 8/1972 | Spreadbury | 323/6 |
| 3,739,257 | 6/1973 | Hunter | 323/50 |
| 3,781,630 | 12/1973 | Ballman | 320/21 |
| 3,803,479 | 4/1974 | Rathor | 323/44 |
| 3,824,449 | 7/1974 | Hase | 323/6 |
| 3,965,408 | 6/1976 | Higuchi et al. | 321/25 |
| 4,039,900 | 8/1977 | Roback et al. | 361/388 |
| 4,081,777 | 3/1978 | Cronk | 336/165 |
| 4,130,790 | 12/1978 | Heisey | 323/60 |
| 4,189,672 | 2/1980 | Peschel | 336/149 |
| 4,274,071 | 6/1981 | Pfarre | 336/12 |
| 4,339,706 | 7/1982 | Kusko | 323/248 |
| 4,460,954 | 7/1984 | Aiken et al. | 363/75 |
| 4,549,130 | 10/1985 | Dobberstein | 323/308 |
| 4,656,412 | 4/1987 | McLyman | 320/39 |
| 4,694,241 | 9/1987 | Genuit | 323/340 |
| 4,774,649 | 9/1988 | Archer | 323/248 |
| 4,943,763 | 7/1990 | Bobry | 323/309 |
| 4,975,649 | 12/1990 | Bobry | 324/547 |
| 5,272,831 | 12/1993 | Willis | 336/165 |
| 5,426,579 | 6/1995 | Paul et al. | 353/126 |

*Primary Examiner*—Jeffrey Sterrett
*Attorney, Agent, or Firm*—Westman, Champlin & Kelly, P.A.; S. Koehler

[57] ABSTRACT

An AC ferroresonant transformer includes a core having a closed loop path and a magnetic shunt assembly extending between portions of the core. A primary winding, a secondary winding and a tertiary winding are disposed on the core to link with magnetic flux in the core and the magnetic shunt. The tertiary winding includes terminals that are electrically isolated from the secondary winding. A first aspect of the present invention includes a tank capacitor connected to the tertiary terminals to form two LC circuits wherein a first LC circuit is a resonant circuit and a second LC circuit is a filtering circuit. Another aspect of the present invention is a method of operating an AC ferroresonant transformer proximate a knee of a B-H curve of the core, at minimal line voltage and full load, to reduce the generated harmonics.

19 Claims, 2 Drawing Sheets

ALTERNATING CURRENT FERRORESONANT TRANSFORMER WITH LOW HARMONIC DISTORTION

BACKGROUND OF THE INVENTION

The present invention relates to a regulation system for providing electrical power. More particularly, the present invention relates to an alternating current ferroresonant transformer having a primary input winding, a secondary output winding, and a tertiary winding having a tank capacitor connected to terminals of the tertiary winding to form a resonant circuit.

Ferroresonant transformers are well known devices that maintain a substantially constant output voltage despite fluctuations of an input source voltage. Typically, the ferroresonant transformer includes a core and magnetic shunt assemblies forming closed loop paths and core sections for magnetic flux generated and/or linked by a primary winding, a secondary winding and a tertiary winding. A core section, which carries the flux, and which links the secondary winding, is generally heavily saturated. Output terminals of the secondary winding provide electrical power to a load, while a tank capacitor is connected across the terminals of the tertiary winding, and which may also be connected electrically to the secondary winding, to form a resonant circuit.

Ferroresonant transformers generally produce an output voltage signal which approximates an AC square wave due to the highly saturated secondary core. For DC applications, this square wave output need only be rectified to produce the desired regulated DC voltage source. For AC applications, either external or internal filters must be added to filter out the harmful higher harmonics of the square wave to produce an acceptable AC output voltage with an acceptable Total Harmonic Distortion (THD).

Although AC ferroresonant transformers and DC ferroresonant transformers include common elements described above, interconnection of the elements, placement of the elements on the core, and saturation of a portion or portions of the core are changed depending upon the type of output voltage signal desired. For example, a conventional DC ferroresonant transformer design usually entails a heavily saturated secondary core section in order to produce a regulated output voltage resulting from the fixed volt-time area of the magnetic core. As the saturation level of the secondary core section increases, the content of harmonic current produced at the output terminals of the secondary winding also increases. This type of ferroresonant transformer produces a square wave output voltage signal with high THD. In addition, the output terminals typically include a tap taken off the tertiary winding. This eliminates the need of having a separate secondary winding, but does require an increase in copper size of the tertiary winding to handle the vector sum of the tertiary and load current. Although a DC ferroresonant transformer does include magnetic shunt assemblies that form alternate magnetic paths within the core structure, typically, the magnetic shunts are lightly saturated or, perhaps, not saturated at all, in order to produce predictable results in the design.

Each of the aforementioned design approaches are used singularly or in combination and are appropriate in DC applications because harmonic content of the output voltage is not of concern. In fact, the resultant square wave is preferred because upon rectification and filtering, a constant DC voltage is realized.

In contrast to the DC ferroresonant transformer, an alternating current ferroresonant transformer must minimize harmonic content in the output power provided. A ferroresonant transformer of this type receives an input AC signal and produces a substantially constant sinusoidal output signal that has minimal harmonic content. Therefore, since the design goal for DC ferroresonant transformers is to increase harmonic content in the output signal, the teachings applicable to these types of ferroresonant transformers would not be applicable to AC ferroresonant transformers.

U.S. Pat. No. 2,694,177 describes an AC ferroresonant transformer to minimize harmonics in the output signal. The transformer includes a core formed of laminations having three distinct pairs of coil windows for windings. A primary winding and a compensating winding are disposed within the first set of coil windows. A secondary winding is disposed within the second set of coil windows, and a neutralizing (filtering) winding is disposed within the third set of coil windows with the secondary winding interposed between the primary/compensating windings and the neutralizing winding. Magnetic shunts are formed between each set of coil windows to form alternate magnetic paths in addition to a common magnetic path extending through each of the windings. A capacitor is connected in circuit with the secondary winding, the neutralizing winding and the compensating winding. An output signal is obtained across a terminal of the compensating winding and a node formed between the secondary winding and the neutralizing winding. This design is an example of a ferroresonant transformer producing an AC square wave and using an internal filter circuit to provide the desired AC sinusoidal wave with acceptable THD.

There is an ongoing need to provide a simpler alternating current ferroresonant transformer with less windings and/or less magnetic shunts in order to minimize construction costs, while further minimizing the harmonic content in the output signal and providing a substantially constant sinusoidal output signal for a given range of input voltages.

SUMMARY OF THE INVENTION

An AC ferroresonant transformer includes a core having a closed loop path and a magnetic shunt assembly extending between portions of the core. A primary winding, a secondary winding and a tertiary winding are disposed on the core to link with magnetic flux in the core and the magnetic shunt. The tertiary winding includes terminals that are electrically isolated from the secondary winding.

A first aspect of the present invention includes a tank capacitor connected to the tertiary terminals to form two LC circuits wherein a first LC circuit is a resonant circuit and a second LC circuit is a filtering circuit. Another aspect of the present invention is a method of operating an AC ferroresonant transformer proximate a knee of a B-H curve of the core, at minimal line voltage and full load, to reduce the generated harmonics.

In a preferred embodiment, the AC ferroresonant transformer includes a core forming a first closed loop path wherein the core has two air gaps of increased reluctance to magnetic flux in the first closed loop path. The magnetic shunt assembly is disposed between portions of the core to form a second closed loop path and a third closed loop path. The magnetic shunt assembly has an air gap of increased reluctance to magnetic flux in the second and third closed loop paths. The primary winding has primary terminals connectable to a source for receiving current. The primary winding is disposed on the core to link with magnetic flux in the first closed loop path and the second closed loop path. The secondary winding has secondary terminals connectable to a load and is disposed on the core to link with magnetic flux in the first closed loop path and the third closed loop path. The tertiary winding has tertiary terminals electrically isolated from the secondary winding and is disposed on the core spaced-apart from the secondary winding to link with the magnetic flux in the first closed loop path and the third closed loop path. The secondary winding is disposed between the primary winding and the tertiary winding. The tank capacitor is connected to the tertiary terminals to form the resonant circuit and the filtering circuit.

The other aspect of the present invention is a method of operating an AC ferroresonant transformer to have total harmonic distortion below a selected value and a line/load regulation above a selected value. The method includes generating a magnetic flux in a secondary portion of a core under a secondary winding to saturate the secondary portion of the core, at minimal line voltage and full load, at a maximum level proximate a knee of the curve; and saturating a magnetic shunt extending between portions of the core to obtain an output voltage across the secondary winding within the selected line regulation. In a preferred embodiment, saturation of the secondary portion of the core, at minimum line voltage and full load, at a maximum level is in a range of about −5% to about 15% of the knee of the core.

DETAILED DESCRIPTION OF THE PREFERRED EMBODIMENTS

Figure 1:
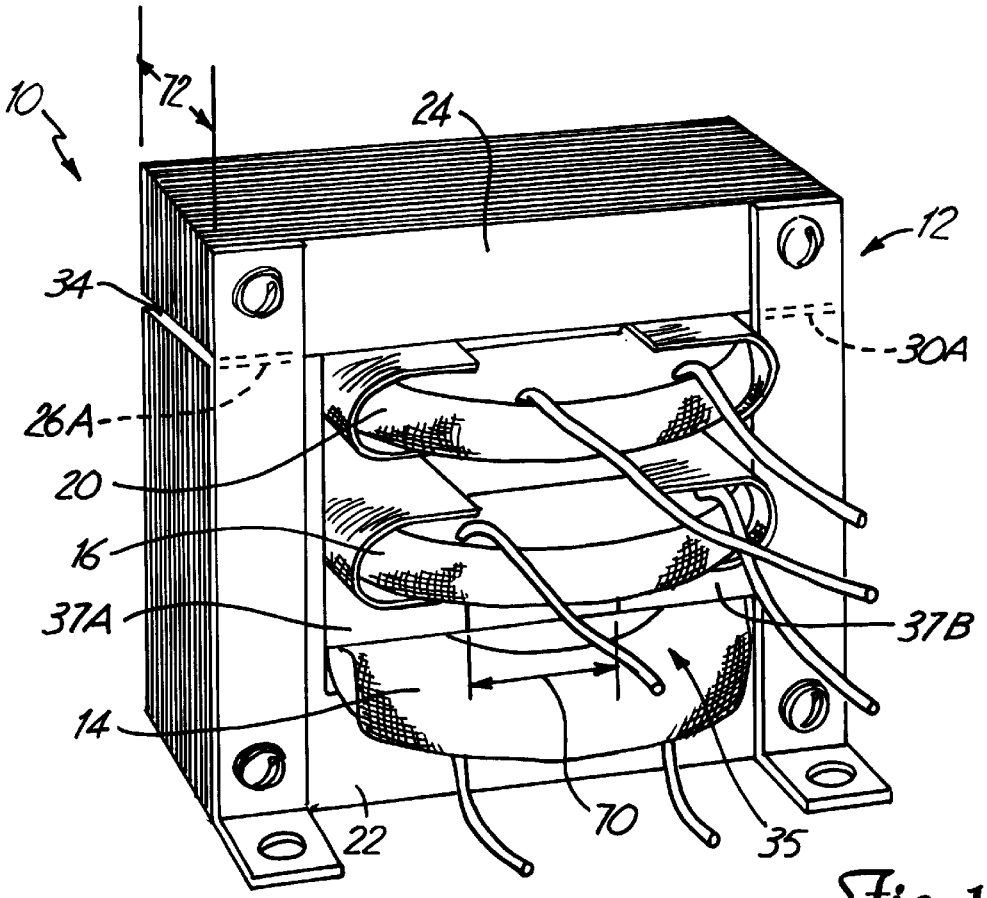
FIG. 1 is a perspective view of an AC ferroresonant transformer made in accordance with the present invention.
Figure 2:
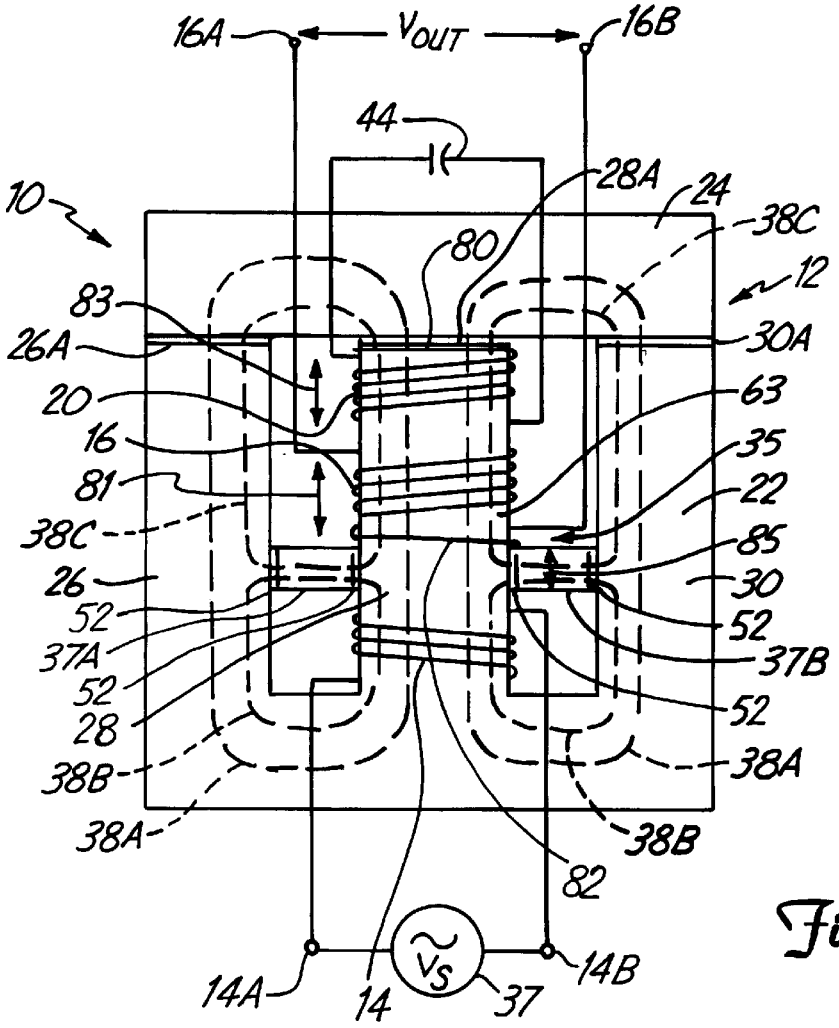
FIG. 2 is a schematic view of a core and windings of the AC ferroresonant transformer of FIG. 1.
Figure 3:
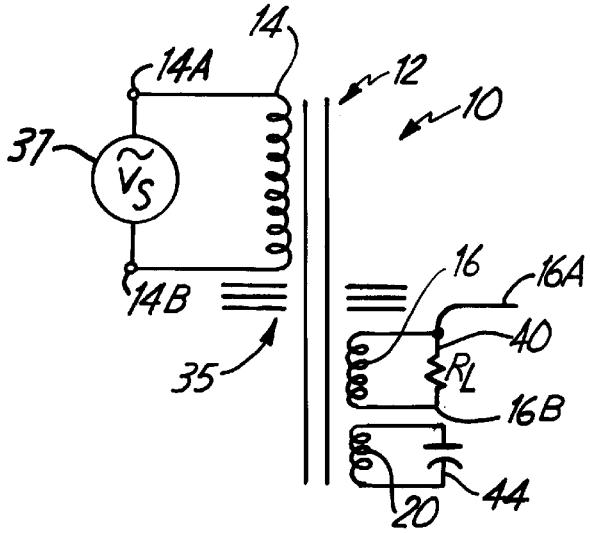
FIG. 3 is a diagrammatic representation of the AC ferroresonant transformer of FIG. 1.

An embodiment of an alternating current (AC) ferroresonant transformer is illustrated in FIGS. 1–3 generally at 10. The AC ferroresonant transformer 10 includes a core 12, a primary winding 14, a secondary winding 16 and a tertiary winding 20. In the embodiment illustrated, the core 12 is formed from first and second groups of laminations 22 and 24, comprising E-laminations and I-laminations, respectively. The first group of E-laminations 22 includes extending portions 26, 28 and 30, the ends of which are positioned proximate the second group of I-laminations 24. In the embodiment illustrated, air gaps 26A, 28A and 30A are equal and are formed between the ends of the extending portions 26, 28 and 30, respectively, and the second group of I-laminations 24.

A magnetic shunt assembly 35 is disposed between portions of the core 12 to form multiple closed loop paths for magnetic flux. In the embodiment illustrated, the magnetic shunt assembly 35 includes magnetic shunts 37A and 37B disposed in the core 12 between the extending portions 26, 28 and 30, and longitudinally disposed between the primary winding 14 and the secondary winding 16. The core 12 and magnetic shunt assembly 35 form symmetrical first closed magnetic loop paths 38A, symmetrical second closed magnetic loop paths 38B and symmetrical third closed magnetic loop paths 38C. Air gaps 26A, 28A and 30A create a portion of increased reluctance to magnetic flux in the first closed magnetic loop paths 38A and the third closed magnetic loop paths 38C. The air gaps 52 create a portion of increased reluctance to magnetic flux in the second closed magnetic loop paths 38B and the third closed magnetic loop paths 38C. Material can be wedged between the ends of the magnetic shunts 37A and 37B and the extending portions 26, 28 and 30 in order to make the magnetic shunts 37A and 37B fit and still have specified air gaps to create increased reluctance.

The primary winding 14 includes terminals 14A and 14B adapted to be connected to a suitable AC source 37, for example, 120 volt, 60 hertz to receive electrical power therefrom. The primary winding 14 is disposed on the core 12 to generate magnetic flux in the first closed magnetic loop path 38A and in the second closed magnetic loop path 38B. The secondary winding 16 is disposed on the core 12 to link with the magnetic flux in the first magnetic closed loop path 38A and the third magnetic closed loop path 38C. The secondary winding 16 includes secondary output terminals 16A and 16B connectable to a load indicated schematically at 40 as $R_L$ in FIG. 3.

The tertiary winding 20 is electrically isolated from the secondary winding 16 and disposed on the core 12 spaced-apart from the secondary winding 16 to link with the magnetic flux in the first magnetic closed loop path 38A and the third magnetic closed loop path 38C. A tank capacitor 44 is connected to the tertiary winding 20 to provide a resonant circuit near the fundamental frequency of the AC source 37.

As appreciated by those skilled in the art, the core 12 is symmetrical about the center extending portion 28 thereby forming symmetrical paths for magnetic flux. Although illustrated with two first closed magnetic loop paths 38A, two second closed magnetic loop paths 38B, and two third closed magnetic loop paths 38C, it should be understood that a suitable core structure and a suitable magnetic shunt assembly forming only one first closed magnetic loop path 38A, one second closed magnetic loop path 38B, and one third magnetic loop path 38C can also be used.

Two independent aspects of the present invention include reducing generation of harmonics in the secondary winding 16 by design and control of saturation of the core 12 and the magnetic shunt assembly 35; and attenuation of generated harmonics by the creation of a LC filtering network.

Reducing Generated Harmonics

In general, reducing the levels of saturation in the secondary portion 63 of the core 12 reduces the harmonic generated in the secondary winding 16. Harmonics generated of the secondary winding 16 due to magnetic flux flowing in a secondary portion 63 (FIG. 2) of the core 12 is also minimized by controlling a ratio of the air gaps 26A, 28A and 30A in the core 12 and the air gaps 52 of the magnetic shunt assembly 35.

Generally, harmonic content in the secondary winding 16 and voltage regulation of the secondary winding 16 are related to the design of the core 12 and magnetic shunt assembly 35. As appreciated by those skilled in the art, general dimensions of the core 12 and the magnetic shunt assembly 35 are directly related to the KVA rating of the ferroresonant transformer 10 and, therefore, are dependent upon each specific application. However, it has been found that certain design considerations for the core 12 and the magnetic shunt assembly 35 reduce the harmonic content in the secondary winding 16, while maintaining required voltage regulation at low line—full load conditions.

The core design parameters include the width of the extending portion 28 indicated by arrow 70, a stack length indicated by arrow 72, the dimension of air gaps 26A, 28A, and 30A, the material used for the E-laminations 22 and the I-laminations 24 and the number of turns for the primary winding 14, the secondary winding 16 and the tertiary winding 20. Commercially available M-6, 29 gauge, electrical steel laminations designed specifically for ferroresonant transformers can be used for the E-laminations 22 and the I-laminations 24. The required KVA output of the ferroresonant transformer will determine the number of laminations used to form the required stack length 72. In the embodiment illustrated, the E-laminations 22 and the I-laminations 24 are of equal stack length.

The number of turns for the primary winding 14 and the secondary winding 16 are determined from the B-H operating point for closed loop magnetic paths 38A, 38B and 38C. At low line input voltage from the AC source 37 and at full load (1.0 power factor), the number of primary, secondary, and tertiary turns should provide a sufficient amount of magnetic flux in the secondary portion 63 of the core 12 to enter the saturation region of the B-H curve just above the knee of the saturation curve.

Figure 4:
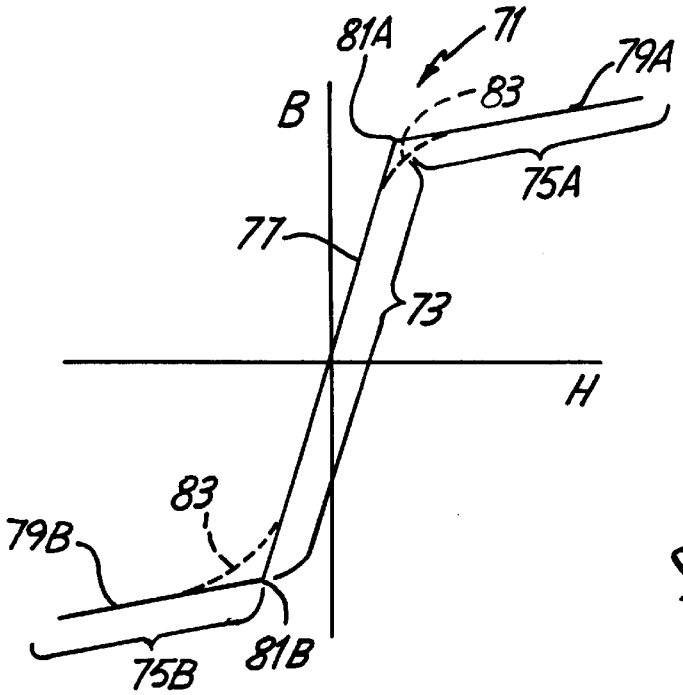
FIG. 4 is a graphical representation of a B-H curve of a core material.

Referring to FIG. 4, a B-H curve for the AC ferroresonant transformer 10 is indicated at 71. As is known, the B-H curve 71 includes a substantially linear region 73 and saturated regions 75A and 75B. Although the B-H curve 71 is non-linear, a line segment 77 can be used to represent the linear region 73 being extended from a substantially constant slope of the linear region 73. Similarly, the saturated regions 75A and 75B can also be represented by line segments 79A and 79B, respectively. Line segments 79A and 79B are extended from substantially constant slope regions of the saturated regions 75A and 75B.

For purposes of this application, knees 81A and 81B of the B-H curve 71 are defined as the intersection between line segment 77 and line segment 79A, and, line segment 77 and line segment 79B, respectively, although the actual B-H curve has knees of smoother transition as indicated with dashed lines 83. Unlike prior art AC ferroresonant transformers, which operate well into the saturated regions 75A and 75B, one aspect of the AC ferroresonant transformer of the present invention includes maximum saturation of the secondary core portion 63, at minimum line voltage and full load, proximate the knees 81A and 81B, preferably, within a range of about −5% to about +15% of the knees 81A and 81B. In another preferred embodiment, the maximum saturation of secondary core portion 63 is within a range of about −2% to about 10% of the knees 81A and 81B at minimum line voltage and full load. In another preferred embodiment, the maximum saturation of the secondary core portion 63 is within a range of about +1% to about +5% of the knees 81A and 81B at minimum line voltage and full load.

By operating close to the knees 81A and 81B, the AC ferroresonant transformer 10 is lightly saturated in order to minimize generated harmonic currents. The prior art AC ferroresonant transformers do not operate in this region because substantial saturation of the secondary core of the ferroresonant transformer is necessary to maintain specified load regulation. In the present invention, the magnetic shunt assembly 35 is heavily saturated while the secondary core portion 63 is lightly saturated in order to maintain the specified voltage regulation.

The number of turns for the secondary winding 16 should be just sufficient to produce the minimum specified output voltage. If the shunts 37A and 37B are properly saturated, as magnetic flux increases in the secondary core portion 63 of the core 12 with increases in input voltage on the primary winding 14, specified load regulation is achieved.

It has been found that the required dimension of the air gap 26A in the core 12 can be approximated as a percentage of the sum of the height of the secondary winding 16 indicated by arrow 81, and the height of the tertiary winding 20, indicated by arrow 83. In particular, it has been found that a suitable dimension of the air gap 26A is approximately 1% of the sum of the height of the secondary winding 16 and the tertiary winding 20.

Filtering Generated Harmonics

The filtering aspect of the invention relates to the fact that it has been discovered that proper placement of the primary winding 14, the secondary winding 16 and the tertiary winding 20 on the core 12 will significantly reduce the harmonic content in the output voltage from the secondary terminals 16A and 16B. In particular, it has been found that physically and electrically isolating the tertiary winding 20 from the secondary winding 16 and disposing the tertiary winding 20 on the core 12 proximate the air gaps 26A, 28A and 30A, creates a leakage inductance in the tertiary winding 20 (inductance associated with the magnetic flux that links the tertiary winding 20, but does not link with the secondary winding 16). The leakage inductance of the tertiary winding 20 and the capacitance of the tank capacitor 44 form an electrical zero (herein defined as the frequency at which the impedance of the LC circuit is a minimum) in the lower harmonics, preferably below the ninth harmonic of the fundamental frequency, and more preferably near or below the sixth harmonic, which allows harmonic currents to flow in the tertiary winding 20, thereby significantly attenuating harmonics in the secondary winding 16.

Another benefit of the L-C filtering circuit is that switching loads connected to the secondary winding 16, which draw harmonic currents from the secondary winding 16, can be reflected in the tertiary winding 20 due to the presence of the electrical zero. Thus, the tertiary winding 20 is maintained in resonant In the embodiment illustrated then, two LC circuits are formed with the capacitor 44. A first LC circuit is a resonant circuit with a resonant frequency near 60 cycles. The LC resonant circuit is formed by the primary and secondary leakage inductance and the capacitance of the tank capacitor 44. A second LC circuit is a filtering circuit. The LC filtering circuit forms the electrical zero in the lower harmonics, which allows harmonic currents to flow in the tertiary winding 20, and thus, attenuates harmonics in the secondary winding 16. The LC filtering circuit is formed with the leakage inductance of the tertiary winding 20 and the capacitance of the tank capacitor 44.

As with the design of the core 12, the magnetic shunt assembly 35 is also designed to maintain the specified output voltage regulation, while keeping the harmonic content in the output signal low. In the embodiment illustrated, the magnetic shunt assembly 35 includes the magnetic shunts 37A and 37B disposed between the extending portions 26 and 30 and the center extending portion 28. Design parameters of the magnetic shunts 37A and 37B include the material used for the magnetic shunts 37A and 37B, the shunt height indicated by arrow 85 and the length of the shunts 37A and 37B (which typically equals the stack length 72), and the is dimension of the air gaps 52. Preferably, the shunt material is sheet steel rather than electrical steel used in the core 12 because the sheet steel has a more rounded B-H curve which will result in a more stable shunt flux.

Sources of magnetic flux in the magnetic shunts 37A and 37B include magnetic flux generated in the second closed magnetic loop paths 38B from current in the primary winding 14, and magnetic flux generated in the third closed magnetic loop paths 38C from current in the tertiary winding 20 as well as current in the secondary winding 16 when load is applied. In the magnetic shunts 37A and 37B, at no load, the magnetic flux generated by the primary winding 14 in the second closed magnetic loop paths 38B is 180 degrees out of phase with the magnetic flux generated by the tertiary winding 20 in the third closed magnetic loop paths 38C. Therefore, as the input voltage on the primary winding 14 is increased, the magnetic flux flowing in the magnetic shunts 37A and 37B will decrease. As unity power factor load current is drawn from the secondary winding 16, the magnetic flux generated by the secondary winding 16 lags the no load magnetic flux generated from the tertiary winding 20 by almost 90 degrees. However, as the magnetic flux from the secondary winding 16 increases, the resultant secondary flux, driving both the secondary and tertiary currents, rotates to lag the no load current flux. The magnetic flux generated from the tertiary winding 20 and secondary winding 16 rotates as well in the magnetic shunts 37A and 37B, which reduces the magnetic flux from its previous no load level, and causes it to lag the magnetic flux generated from the primary winding 14.

The high shunt reluctance formed by air gaps 52 is in series with the reluctance formed by the air gaps 26A, 28A and 30A of the core 12 as seen by the tertiary winding 20 and the secondary winding 16. As discussed above, the secondary portion 63 of core 12 is lightly saturated (low reluctance) in order to minimize the generation of harmonics in the secondary winding 16. In contrast, the magnetic shunts 37A and 37B are heavily saturated over a large portion of the voltage cycle in order to create a high reluctance. In this manner, the heavily saturated magnetic shunts 37A and 37B maintain an average leakage inductance sufficient to resonate with the capacitance of the tank capacitor 44 to produce a desired resonant gain to maintain voltage regulation. A shunt gap (sum of the air gaps 52 for one shunt 37A or 37B) can be specified as a percentage of a core gap (sum of the air gaps 26A and 28A, or the sum of the air gaps 26A and 30A, due to the symmetry of the core 12). In the preferred embodiment, to minimize the effect of the 180 degree magnetic flux generated by the primary winding 14, the shunt gap should be approximately equal to the core gap. It should be understood that the shunt gap can be made less than or greater than the core gap. However, it has been found that a lightly saturated magnetic shunt assembly 35 with a high input line voltage and high load conditions can produce oscillations in the output voltage of the secondary winding 16 if the magnetic flux in the shunt passes through zero while the magnetic flux in the secondary portion 63 of the core 12 is still in the heavily saturated region. The design of the shunt assembly 35 must avoid this condition by a sufficiently high saturation of the shunt assembly 35.

The tank capacitor 44 should have a capacitance sufficient to provide a resonant circuit with the leakage inductance of the tertiary winding 20 which will produce a gain of about 1.05 to about 1.20 and, preferably, to provide a gain of about 1.08 to about 1.15. The gain is intentionally very low because high gain will produce higher harmonics and more instability at higher input voltages on the primary winding 14. It is believed that this gain also allows variation in the leakage inductance of the tertiary winding 20 due to different saturation levels at different operating conditions.

To demonstrate the performance of this invention, a prototype having the construction as illustrated in FIGS. 1–3, was designed, built, and tested. The ratings of the device were 3.1 KVA (60 Hertz), input voltage from 102 to 132 volts AC, output voltage 120 volts AC, ±5%.

The tested structure parameters were:

Stack length 72 of 4.875 inches of FR2125 laminations;

Primary winding 14 of 38 turns;

Secondary winding 16 of 34 turns;

Tertiary winding 20 of 160 turns;

22 PC.(0.400) steel shunts 37A and 37B with 0.062 inches shunt gap;

Main flux air gaps 26A, 28A and 30A of 0.030 inches; and

Tank capacitor 44 having a value of 65 $\mu$F.

It should be noted that this prototype was made larger than needed for 3.1 KVA to facilitate various testing schemes. The required stack length of FR2125 for 3.1 KVA using the teachings described would be approximately 4.0 inches instead of the actual 4.875 inches used.

To ascertain the position of the electrical zero created by the leakage inductance of the tertiary winding 20 and the tank capacitor 44, a top search coil 80 was disposed on the center extending portion 26 above the tertiary winding 20 and proximate the air gap 26A, and a bottom search coil 82 was disposed on the center extending portion 26 below the secondary winding 16 proximate the magnetic shunts 50. As appreciated by one skilled in the art, the harmonic content of voltages generated in the search coils 80 and 82 is related to the harmonic content of the magnetic flux in the center extending portion 26. By comparing the amplitude of each harmonic voltage in the top search coil 80 with the amplitude of the corresponding harmonic voltage in the bottom search coil 82, attenuation due to the electrical zero formed by the leakage inductance of the tertiary winding 20 and the tank capacitor 44 can be ascertained.

The following table provides measured harmonic attenuation for the third, fifth, seventh and ninth harmonics at low line primary voltage (102 volts), nominal line primary voltage (120 volts) and high line primary voltage (132 volts) at no load for the test structure described above. Each entry is the amount of harmonic content measured in the bottom search coil 82 as expressed as a factor of the corresponding harmonic content in the top search coil 80. For example, a value of 0.75 means 75% of the harmonic content in the top search coil 82 was present in the bottom search coil 80, or that the harmonic content was attenuated by 25%.

| Harmonic | Low Line (102 V) | Nominal Line (120 V) | High Line (132 V) |
|---|---|---|---|
| 3 | .75 | .69 | .62 |
| 5 | .50 | .28 | .28 |
| 7 | .17 | .23 | .26 |
| 9 | * | .59 | .60 |

*Unmeasurable due to very low amplitude in the top search coil 80.

From the table above, at low line, no load, the electrical zero is approximately near the seventh harmonic. At nominal line, no load, the electrical zero is approximately near the sixth harmonic. At high line, no load, the electrical zero is below the sixth harmonic since the attenuation of the third harmonic has decreased from the level at nominal line, no load. The position of the electrical zero decreases because leakage inductance of the tertiary winding 20 increases due to increases in saturation of the secondary portion 63 from increases in line voltage.

The Total Harmonic Distortion (THD) in the output signal for no load and full load conditions at minimum, nominal and maximum input voltages were measured to be as follows for the test structure described above:

| | | | | |
|---|---|---|---|---|
| (1) | VOLTS IN | | 102 | |
| | | No Load | | Full Load |
| | VAC OUT | 121.9 | | 106.8 |
| | THD % | 4.4 | | 0.6 |
| (2) | VOLTS IN | | 120 | |
| | | No Load | | Full Load |
| | VAC OUT | 122.0 | | 120.5 |
| | THD % | 7.1 | | 2.5 |
| (3) | VOLTS IN | | 132 | |
| | | No Load | | Full Load |
| | VAC OUT | 124.0 | | 122.2 |
| | THD % | 8.5 | | 6.3 |

Although the present invention has been described with reference to preferred embodiments, workers skilled in the art will recognize that changes may be made in form and detail without departing from the spirit and scope of the invention. For example, any type of non-ferroresonant material can be disposed in the air gaps without affecting the reluctance.

What is claimed is:

1. An AC ferroresonant transformer comprising:

a core forming a first closed loop path, the core having two air gaps of increased reluctance to magnetic flux in the first closed loop path;

a magnetic shunt assembly disposed between portions of the core to form a second closed loop path and a third closed loop path that are each shorter in length than the first closed loop path, the magnetic shunt assembly having an air gap of increased reluctance to magnetic flux in the second and third closed loop paths;

a primary winding having primary terminals connectable to a source for receiving current, the primary winding being disposed on the core to link with magnetic flux in the first closed loop path and the second closed loop path;

a secondary winding having secondary terminals connectable to a load, the secondary winding being disposed on the core to link with magnetic flux in the first closed loop path and the third closed loop path;

a tertiary winding having tertiary terminals electrically isolated from the secondary winding, the tertiary winding being disposed on the core spaced-apart from the secondary winding to link with the magnetic flux in the first closed loop path and the third closed loop path, wherein the secondary winding is disposed on the core between the primary winding and the tertiary winding; and a tank capacitor connected to the tertiary terminals to form a resonant circuit and a filtering circuit.

2. The AC ferroresonant transformer of claim 1 wherein the air gap of the magnetic shunt is less than a sum of the air gaps of the core.

3. The AC ferroresonant transformer of claim 1 wherein the air gap of the magnetic shunt is approximately equal to the sum of the air gaps of the core.

4. The AC ferroresonant transformer of claim 1 wherein the core is formed from a first ferromagnetic material and the magnetic shunt is formed from a second ferromagnetic material.

5. The AC ferroresonant transformer of claim 4 wherein the first ferromagnetic material is electrical steel and the second ferromagnetic material is sheet steel.

6. The AC ferroresonant transformer of claim 1 wherein a capacitance of the tank capacitor provides a gain of the resonant circuit in a range of about 1.05 to about 1.20.

7. The AC ferroresonant transformer of claim 6 wherein the capacitance of the tank capacitor provides a gain of the resonant circuit in a range of about 1.08 to about 1.15.

8. The AC ferroresonant transformer of claim 1 wherein the air gap of the magnetic shunt is greater than a sum of the air gaps of the core.

9. An AC ferroresonant transformer comprising:

a core having a closed loop path;

a magnetic shunt extending between portions of the core;

a primary winding disposed on the core to link with magnetic flux in the core and in the magnetic shunt;

a secondary winding disposed on the core to link with magnetic flux in the core and in the magnetic shunt;

a tertiary winding having terminals electrically isolated from the secondary winding, the tertiary winding being disposed on the core spaced-apart from the secondary winding to link with magnetic flux in the core and in the magnetic shunt; and a tank capacitor connected to the tertiary terminals to form a ferroresonant circuit by leakage inductance of the primary and secondary windings with the capacitance of the tank capacitor and a filtering circuit formed by leakage inductance of the tertiary winding with the capacitance of the tank capacitor.

10. The AC ferroresonant transformer of claim 9 wherein the current has a power frequency and the filtering circuit has an electrical zero below a ninth harmonic of the power frequency.

11. The AC ferroresonant transformer of claim 10 wherein the filtering circuit has an electrical zero near a sixth harmonic of the power frequency.

12. A method of operating an AC ferroresonant transformer to have total harmonic distortion below a selected value and a line/load regulation above a selected value, the transformer having a core forming a closed loop path, a magnetic shunt extending between portions of the core, a primary winding disposed on the core to link with magnetic flux in the core and in the magnetic shunt, a secondary winding disposed on the core to link with magnetic flux in the core and in the magnetic shunt, a tertiary winding having terminals electrically isolated from the secondary winding, the tertiary winding being disposed on the core to link with magnetic flux in the core and in the magnetic shunt, and a tank capacitor connected to the tertiary terminals to form a resonant circuit, the method comprising the steps of:

generating a magnetic flux in a secondary portion of the core under the secondary winding to saturate the secondary portion, at minimum line voltage and full load, at a maximum level proximate a knee of the core; and saturating the magnetic shunt to obtain an output voltage across the secondary terminals within the selected line/load regulation.

13. The method of claim 12 wherein the step of generating a magnetic flux includes saturating the secondary portion, at minimum line voltage and full load, at a maximum level in a range of about −2% to about 10% of the knee of the core.

14. The method of claim 12 wherein the step of generating a magnetic flux includes saturating the secondary portion, at minimum line voltage and full load, at a maximum level in a range of about +1% to about 5% of the knee of the core.

15. The method of claim 12 wherein the step of generating a magnetic flux includes saturating the secondary portion, at minimum line voltage and full load, at a maximum level in a range of about −5% to about 15% of the knee of the core.

16. The method of claim 15 wherein the capacitance of the tank capacitor provides a gain of the resonant circuit in a range of about 1.08 to about 1.15.

17. The method of claim 15 wherein a leakage inductance of the tertiary winding and the capacitance of the tank capacitor form a filtering circuit having an electrical zero below a ninth harmonic of a frequency of current in the primary winding.

18. The method of claim 17 wherein the filtering circuit has an electrical zero near a sixth harmonic of the frequency of current in the primary winding.

19. The method of claim 12 wherein a capacitance of the tank capacitor provides a gain of the resonant circuit in a range of about 1.05 to about 1.20.

* * * * *